US006250917B1

(12) United States Patent
Engelberg et al.

(10) Patent No.: US 6,250,917 B1
(45) **Date of Patent: *Jun. 26, 2001**

(54) REGENERATOR/BURNER SYSTEM FOR HEATING A FUEL-FIRED INDUSTRIAL FURNACE

(75) Inventors: Ing Franz Engelberg, Constance (CH); Martin Wicker, Monheim (DE); Gerhard Villinger, Kreuzlingen (CH); Wolfgang Bender, Erkrath (DE)

(73) Assignees: Gautschi Electro-fours S.A. (CH); Betriebsforschungsinstitut, VDEh-Institut fur angewandte Forschung GmbH (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,674

(22) Filed: Nov. 17, 1998

Related U.S. Application Data

(62) Division of application No. 08/820,168, filed on Mar. 19, 1997, now Pat. No. 5,876,197.

(30) Foreign Application Priority Data

Mar. 19, 1996 (DE) ..... 196 10 710
Mar. 4, 1997 (DE) ..... 197 08 550

(51) Int. Cl.[7] ..... F27D 17/00
(52) U.S. Cl. ..... 432/179; 432/180; 432/181
(58) Field of Search ..... 432/179, 180, 432/181

(56) References Cited

U.S. PATENT DOCUMENTS

| | | | | |
|---|---|---|---|---|
| 3,633,886 | * | 1/1972 | Froberg | 432/179 |
| 4,299,561 | * | 11/1981 | Stokes | 432/180 |
| 4,408,983 | * | 10/1983 | Masters et al. | 431/116 |
| 4,522,588 | * | 6/1985 | Todd et al. | 432/181 |
| 4,756,688 | * | 7/1988 | Hammond et al. | 432/180 |
| 5,057,010 | * | 10/1991 | Tsai | 432/179 |
| 5,443,040 | * | 8/1995 | Kaji et al. | 122/13.1 |

FOREIGN PATENT DOCUMENTS

| | | |
|---|---|---|
| 42 33 916 | 4/1994 | (DE) . |
| 2 224 563 | 5/1990 | (GB) . |

* cited by examiner

*Primary Examiner*—Stephen Gravini
*Assistant Examiner*—Jiping Lu
(74) *Attorney, Agent, or Firm*—Sonnenschein Nath & Rosenthal

(57) ABSTRACT

In order to create a regenerative, energy-saving fuel firing for an industrial furnace, particularly for a metal smelting furnace, that can flexibly take all possible time and space operating conditions and demands of the furnace to be heated as well as the thermic conditions of the respectively employed, heat-storing regenerators exactly into consideration, it is inventively proposed that at least two regenerator/burner modules (3) are switchable from burner mode (7) into regenerator mode (7r) (exhaust gas extraction mode) or, respectively, vice versa independently of one another proceeding from the process controller of the industrial furnace (1), namely with employment of reverse valves (11) or reversible ventilators or, respectively, two-stream ventilators.

16 Claims, 6 Drawing Sheets

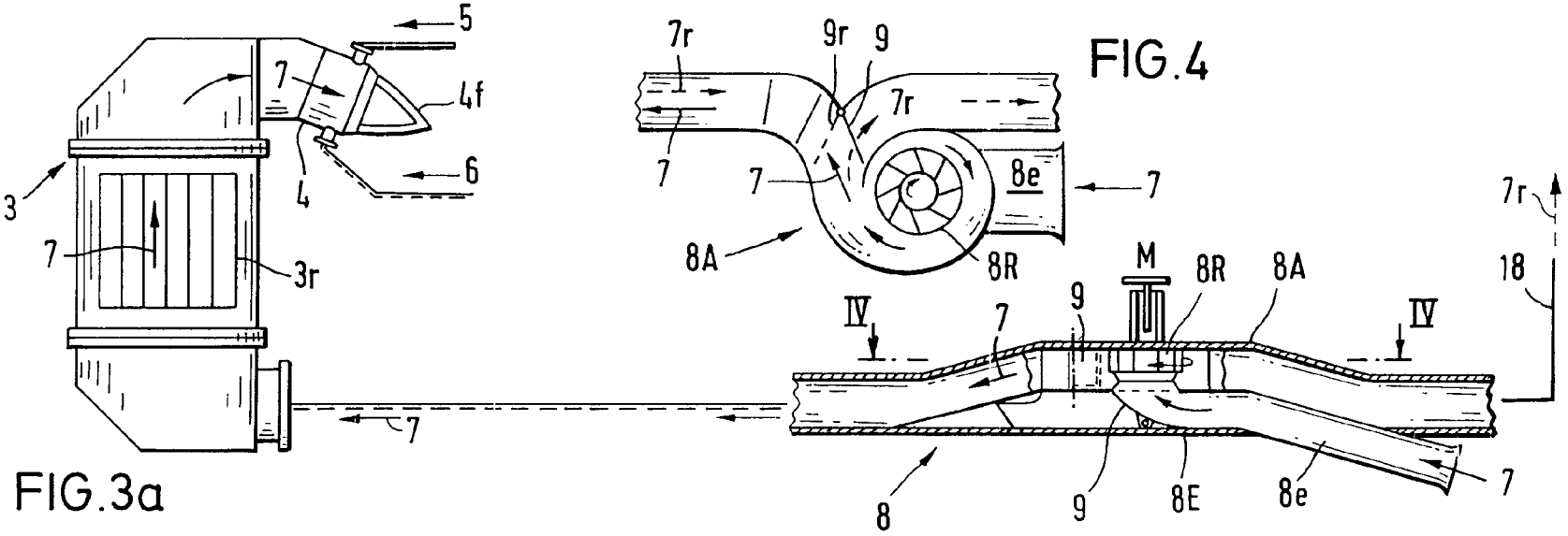
FIG.4
FIG.3a
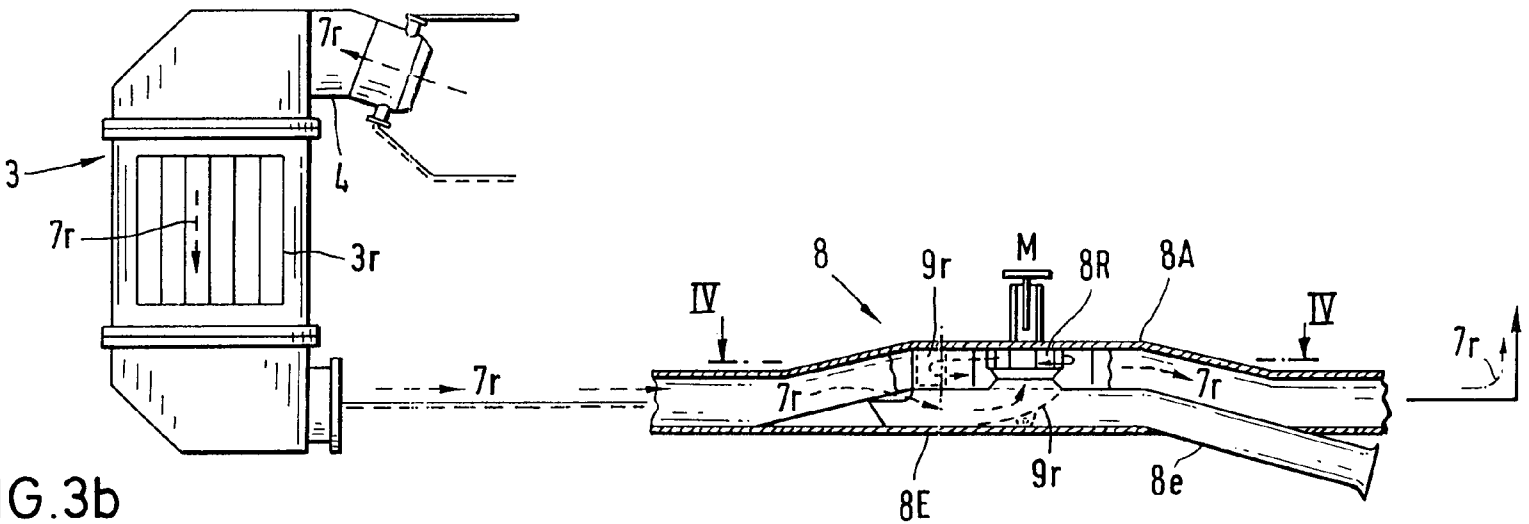
FIG.3b

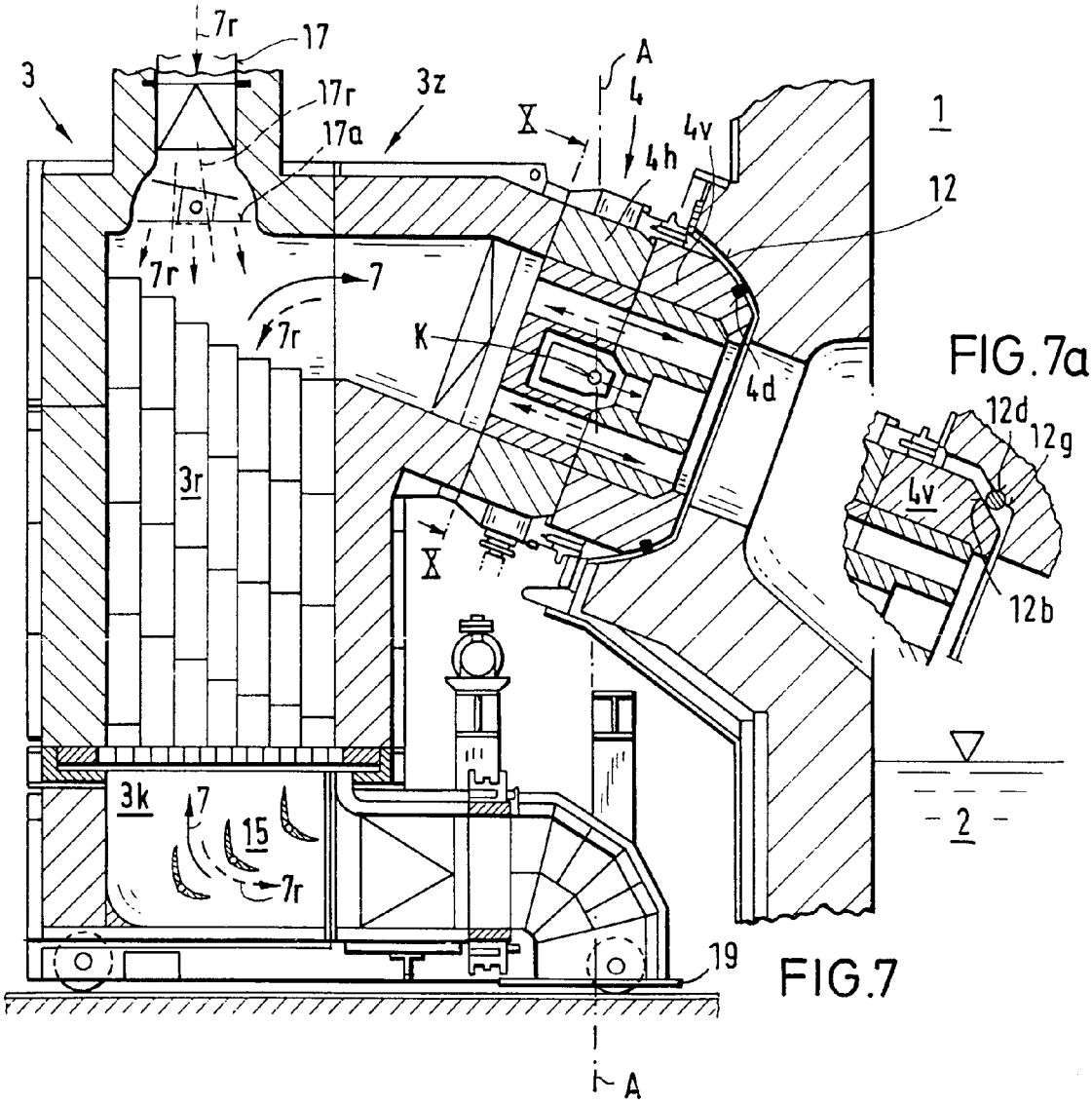
FIG.7a
FIG.7
FIG.8
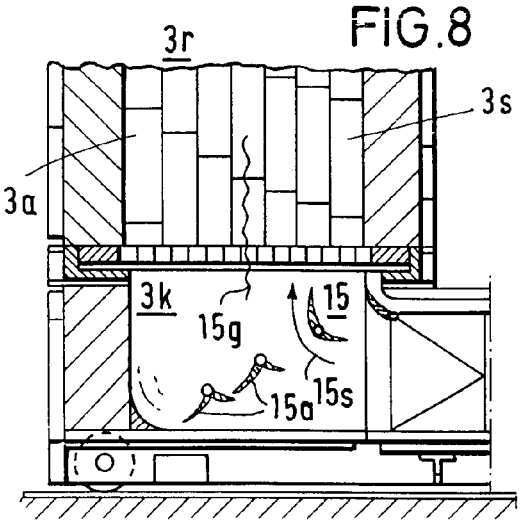
FIG.9
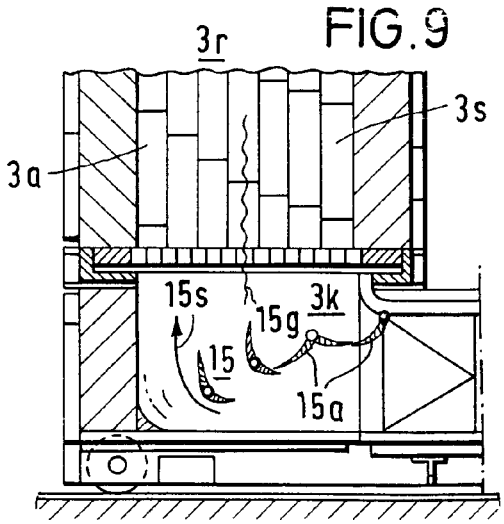

REGENERATOR/BURNER SYSTEM FOR HEATING A FUEL-FIRED INDUSTRIAL FURNACE

This is a division of Ser. No. 08/820,168 filed Mar. 19, 1997, U.S. Pat. No. 5,876,1997.

FIELD OF THE INVENTION

The invention is directed to a method for heating a fuel-fired industrial furnace, particularly a metal smelting furnace, upon employment of regenerators and burners through which hot exhaust gas and cold combustion air flow in alternation. The invention is also directed to a regenerator/burner module system for the implementation of the method.

BACKGROUND OF THE INVENTION

Industrial furnaces such as, for example, aluminum melting furnaces must be heated and kept warm with burners. It is thereby known to utilize regenerators through which hot exhaust gas and cold combustion air flow in alternation. The regenerators being in the position, as heat store, to preheat cold combustion air to high temperature, energy being thereby saved. In the regenerator, the hot exhaust gas cools, for example, from 1200° C. to, for example, 400° C., whereas the cold combustion air can be preheated to, for example, 1000° C. in the regenerator in a following period.

Embodiments previously disclosed for heating industrial furnaces with employment of regenerators and burners proceed on the basis of a paired or, respectively, symmetrical arrangement of the regenerators/burners in a single unit. For example, the storing of the exhaust heat in one regenerator of one pair ensues in the exhaust gas mode (heating periods) and the unstoring of the heat of other regenerator ensues in the other regenerator/burner pair by alternately switching to the burner mode (cooling period) (for example, GB-A-2 224 563). As a result of the strictly paired, symmetrical allocation and operation of the two regenerators, however, individually different thermic conditions of the regenerators as well as time and space demands in view of the heat requirements for the operation of the smelting furnace cannot be taken into consideration, and a fast replacement of the regenerator/burner modules cannot be undertaken in case of maintenance and repair.

SUMMARY OF THE INVENTION

The invention is based on the object of creating a regenerative, energy-saving heating for an industrial furnace, particularly for a metal smelting furnace. The heating can flexibly react to all possible time and space thermic operating conditions and demands of the regenerators as well as to the furnace to be heated, particularly given large smelting furnace systems.

This object is achieved a plurality, an even-numbered or an odd-numbered plurality of regenerator/burner modules arranged distributed around the circumference of an industrial furnace in the inventive method that are switched from burner mode into the regenerator mode from the process controller of the industrial furnace, it also becomes possible to operate the individual regenerator/burner units unpaired or, respectively, asymmetrically, taking operational limits into consideration. There is also the possibility of having burners fire in an over-plurality or in an under-plurality as well. A critical feature of the invention is, thus, that the selection and/or the module ratio of the plurality of firing burners to the plurality of extracted burners (or, respectively, burners with reverse flow) can be variably controlled and, for example, dependent on the thermic condition of the individual regenerator/burner modules (units). The evaluation criteria for the thermic condition of the individual regenerator/burner modules include for example, the exhaust gas temperature and the combustion air temperature. However, a controlled utilization corresponding to the measured or actual furnace temperatures in a plurality of representative furnace sectors, for example with radiant pyrometers, also enables a designational heating of the various furnace regions. In this way, the inventive method for heating a fuel-fired industrial furnace can react flexibly to all possible time and space operating conditions and demands of the furnace to be heated.

According to a further feature of the invention, the clock times of the operation of the respectively firing burner and the respectively extracted burner can be fixed or variable, and the clock times can overlap to a greater or lesser extent. Inventively, the known paired division of the burner units has been cut up into individual burner or, respectively, individual exhaust gas operation. A very beneficial heat distribution is achieved within the furnace to be heated since the firing can be clocked according to the requirements of the smelting material.

The inventive regenerator/burner system for the implementation of the heating method is characterized in that a regenerator and a burner are respectively combined to form a respective, compact regenerator/burner (regenerator burner, regenerator and burner, or regenerative burner) module (unit), whereby at least two regenerator/burner modules are in communication with an exhaust gas conduit with two ventilators that are reversible and/or that interact with reverse valves. Each compact module can be easily separated from the smelting furnace as a unit (i.e. is detachably connected to the smelting furnace) and replaced with a different, available regenerator/burner module. The regenerator/burner module removed from the smelting furnace can then be serviced with appropriate care without interfering with furnace operations. Such a replacement, which causes only short interruptions in operation, can be facilitated when the entire regenerator/burner unit is provided with a truck with which the respective units can be moved away from the furnace. Given a vertical regenerator, a horizontal connecting flange at the regenerator conduit, which is located under the burner projecting in the upper regenerator part, makes it possible to align the burner well. A conical or an annular burner head seat in the furnace housing wall with expansion elements between burner and adapter to the regenerator promotes this.

The burner is directed onto the useful product such as, for example, a molten bath. The regenerator that is arranged immediately in front of the burner can be arranged vertically downward or upward as well. However, a regenerator attached approximately horizontally to the burner is also possible. A gas-permeable bulk fill—for example, of balls or rings—or honeycomb members placed on one another can be utilized as heat store for the vertical regenerator. Honeycomb members are clearly better-suited for horizontal regenerators in most instances. Compared to bulk fills, moreover, ceramic honeycomb members, for example, have a considerably lower flow resistance, the advantage of correspondingly lower ventilator capacities, as well as the advantage of a lower contamination hazard. The distribution of the flow resistances and, thus, the throughput distribution in the regenerator can also be influenced by the layering length of the honeycomb members.

Further, practically no heat losses occur during operation of the compact regenerator/burner since the burner is arranged immediately following the regenerator, and, thus, no lowering of the temperature of the combustion air heated in the regenerator occurs on the very short adapter to the burner. The burner can also be compactly built into the regenerator housing, in regenerator mode, the hot exhaust gas is extracted from the industrial furnace in reverse direction through combustion air channels of the burner directly into the regenerator and heats the latter. The exhaust gas thereby cools down to about 400° C. in the regenerator, so that the following units such as conduits, valves, ventilators and the like are subject to a correspondingly lower thermal load. Additionally, a recirculation conduit can be provided between the upper smelting furnace part and upper regenerator part, so that exhaust gas can additionally flow through the regenerator in regenerator mode.

Ventilator pair may be utilized for the operation of the regenerator/burner modules at a furnace: one ventilator for the combustion air and one ventilator for the exhaust gases. A pair of reverse valves that connect the regenerator to or disconnect the regenerator from the combustion air conduit or the exhaust gas conduit in alternation is allocated to each regenerator/burner module. The regenerator/burner modules in burner mode have the one reverse valve opened to the combustion air conduit and the other closed to the exhaust gas conduit Conversely, the regenerator/burner modules, which, with the burner turned off, have the industrial furnace exhaust gases passing through the regenerator, have a reverse valve to the exhaust gas conduit opened and the other to the combustion air conduit closed. Instead of a reverse valve pair, a reverse pipe shunt or reverse flap can also be employed, these producing a connection to the exhaust gas conduit or combustion air conduit and simultaneously respectively closing the other conduit in alternation.

As modifications, reversible ventilators with reverse flaps can also be utilized in the admission and discharge housing. For mere reversing control of the conveying direction (as in known embodiments), a path change-over in the ventilator admission is added in the reversing ventilators for the regenerator/burner modules, namely from the air intake connection to the regenerator exhaust conduit and vice versa. Specific reverse valves or flaps in the conduits can thereby be foregone. Instead of separate conduits for combustion air and exhaust gases, a respective conduit from a regenerator/burner module to a ventilator suffices, whereby both combustion air as well as exhaust gases are moved through the conduits and ventilators in alternation. The alternating throughput of cold combustion air and hot exhaust gases through the conduits and ventilators in a system also does not allow a continuous thermal load to arise in these components and thus alleviates the stress on the materials.

Such reversible ventilators are in fact known, for example from DE-A-42 33 916, and are in use in heating furnaces for reversing the flow. What is new here, however, is the proposed use for changing over from burner to regenerator mode. Compared to known reversible ventilators that are utilized in closed gas circulation systems, an intake connector must be additionally present in a reversible ventilator for a regenerator/burner module in order to intake combustion air from the atmosphere. Further, a special connection to an exhaust gas discharge must be provided. The flow management through such a regenerator/burner module with a reversible ventilator is as follows:

For conveying combustion air, the reverse flap in the admission housing of the ventilator opens the intake connection in order to intake atmospheric air. When the exhaust gas conduit is closed with the reverse valve in the discharge housing given simultaneous opening of the regenerator conduit, this ventilator conveys the combustion air into the regenerator of the regenerator/burner module. The regenerator previously heated by exhaust gases heats the combustion air and conducts it to the burner. The hot exhaust gases of this burner are suctioned off by another ventilator, being suctioned off through the combustion air channels from other regenerator/burner modules that are in regenerator mode. To this end, the second ventilator in the admission housing has opened the reverse flap to the regenerator conduit while simultaneously closing the intake connection for combustion air. In the discharge housing of this ventilator, the reverse flap produces a connection to the exhaust conduit and simultaneously blocks the regenerator conduit.

BRIEF DESCRIPTION OF THE DRAWINGS

The invention and further features and advantages thereof are explained in greater detail on the basis of exemplary embodiments schematically shown in the FIGS.

Shown are:

FIG. 3*a* Illustrates a schematic diagram of a honeycomb member regenerator with reversible ventilator in burner mode;

FIG. 3*b* Illustrates a schematic diagram of a honeycomb member regenerator with reversible ventilator in regenerator mode;

FIG. 4 Illustrates a section IV—IV in FIG. 3*a*/FIG. 3*b* through the ventilator impeller and the discharge housing with reverse flap in burner mode;

FIG. 7 Illustrates a vertical section through a regenerator/burner that can be pivoted and adjusted around a vertical axis, with vertical honeycomb member regenerator and gas burner whose burner head and seat in the smelting furnace housing is executed annulus-spherical cap-shaped, in an embodiment with adjustable deflection grating in the lower deflection elbow and a recirculation exhaust gas conduit with diffusor discharge flap;

FIG. 7*a* Illustrates a partial section through burner head with annulus-spherical cap and seal ring at the burner seat in the smelting furnace housing;

FIG. 8 Illustrates a vertical section through the lower deflection elbow with closed, left deflection grating part and intensified flushing flow in the right-hand part;

FIG. 9 Illustrates a vertical section through the lower deflection elbow with closed right-hand deflection grating part and intensified flushing flow in the left part;

DETAILED DESCRIPTION OF THE PREFERRED EMBODIMENTS

Figure 1:
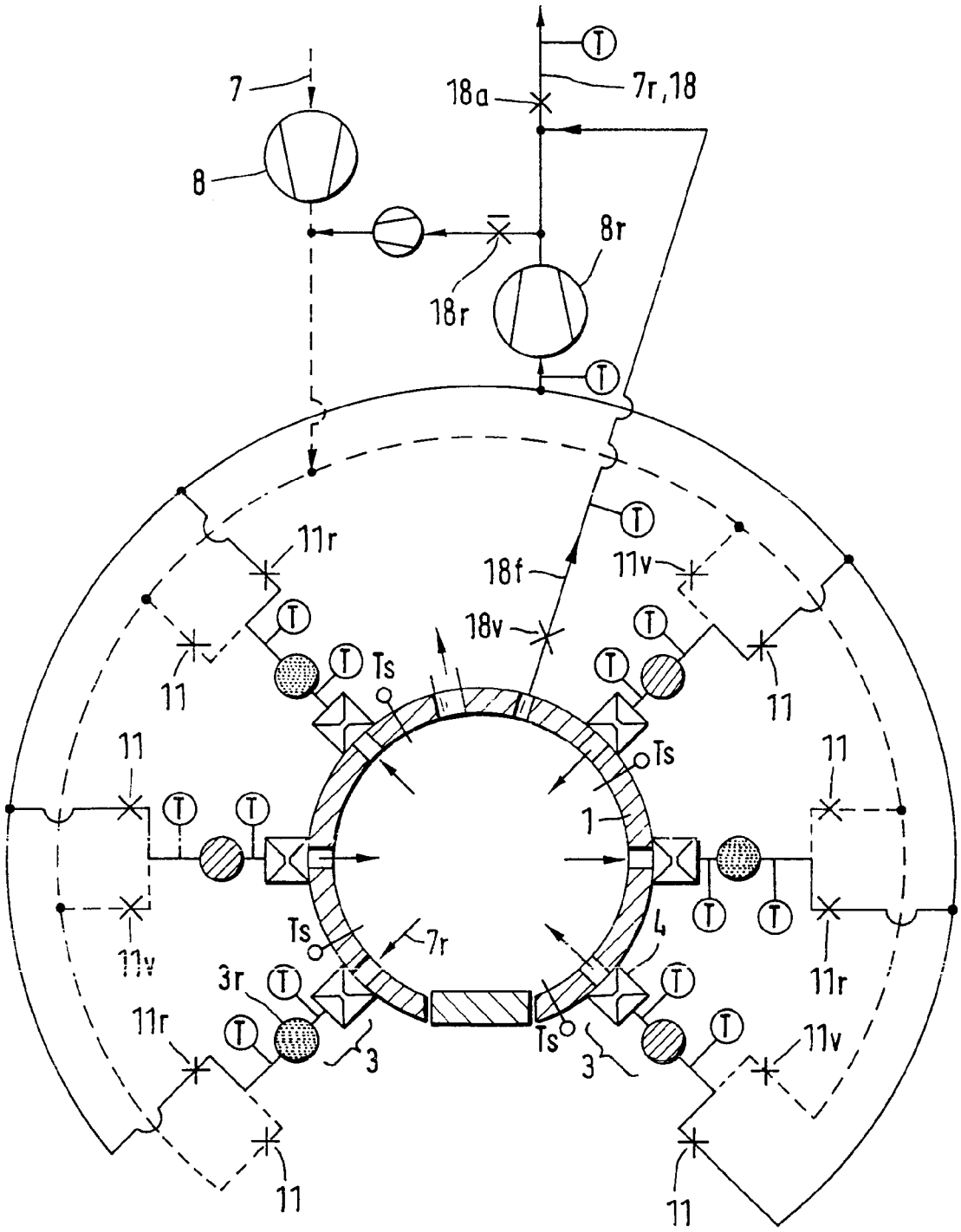
FIG. 1 Illustrates a regenerator/burner module system for heating an aluminum smelting furnace having a round cross-section, comprising six regenerator/burner modules distributed around the furnace circumference.

As an example of the regenerator/burner module system, FIG. 1 schematically shows six regenerator/burner modules arranged distributed around an aluminum smelting furnace. Combustion air 7 flows through the modules via the line system shown with broken lines and regenerator exhaust gas 7*r* via the line system shown with unbroken lines. The exhaust gas flows into common exhaust gas conduit 18. A ventilator 8 is provided for the combustion air 7 and a ventilator 8*r* is provided for the extraction of the exhaust gas. In the heating period, the storage mass of the regenerator 3*r* is heated with the hot exhaust gas from the smelting furnace 1, and, in the cooling period, this is cooled with the cold combustion air 7. In the design case, for example, about 10% of the exhaust gas volume stream can be extracted through a bypass 18*f;* the rest is extracted in about equal parts through the modules with the heating period function. A part of the exhaust gas 7*r* can be branched off downstream from the induced draught ventilator 8*r* and mixed with the cold combustion air 7 via an exhaust gas return for decreasing $No_x$. This combustion air 7 is distributed to the regenerator/burner modules during their cooling period function, is heated and is supplied to the burners 4.

The operation of the inventive regenerator/burner module system is explained with reference to the exemplary embodiment of FIG. 1. In normal operation, three modules are heated with exhaust gas (heating period; shown as solid lines in FIG. 1), and three modules receive cold air and deliver hot combustion air (cooling period; shown as broken lines). When a switch-over criterion is reached, one module changes in function, for example the module at the lower right, from cooling period to heating period of the regenerator after switching the reverse valves 11, 11*v*. In order to keep the capacity constant in terms of fuel engineering, another module will change in function in the opposite way, for example the module at the lower left, from heating to cooling of the regenerator. Subsequently, the other regenerator/burner modules also switch their function. The duration or clock time for the individual periods lies, for example, at about 180 seconds. The typical operating sequence is marked by this constant change in the function of the individual modules.

The operation of the regenerator/burner module system is controlled and regulated by request signals from the process controller of the smelting furnace 1. Based on a predetermined smelting program and the measured or actual operating values of the smelting furnace, the smelting furnace process controller determines the overall firing capacity that is needed. This value is handed over to the process controller of the regenerator/burner module system.

A change in capacity can be achieved by continuous regulation of the individual burners and/or by changing the module ratio of the plurality of firing burners. Apart from the standard operating case, which is 3:3 ratio operation (3 burners fire and the corresponding modules supply hot combustion air, whereas the exhaust gas from the smelting furnace flows through the 3 other modules into the exhaust gas conduit 18) in this case, at least three other operating ratio's are possible and provided:

4:2 operation (four burners fire)

2:4 operation (two burners fire)

1:5 operation (one burner fires).

The 4:2 operation is envisioned for brief-duration overload operation and for nominal load operation given a low combustion air temperature. The 2:4 and the 1:5 mode are envisioned for partial load operation. For the brief-duration 4:2 overload mode, the adequately dimensioned bypass 18*f* must be opened as exhaust gas bypass to the two heating regenerators in order to enable an increased combustion air throughput for the four firing burners. This can be correspondingly achieved with an exhaust gas ventilator in the bypass or with an additional, variable-speed exhaust gas ventilator.

A fixed or a flexible time grid can be utilized for the switch-over criteria of the individual regenerator/burner modules. Given a fixed time grid, the individual modules change in function according to predetermined, fixed time spans or clock times. The change-over events can be chronologically graduated in a plurality of groups in order to achieve optimally uniform operation. Volume streams and cycle durations in the heating period of the regenerator should be defined such that the stored heat quantities are approximately constant for all operating cases.

Given the temperature-guided switching with a flexible time grid, the change-over events of the modules are controlled dependent on the thermic condition of these modules. The evaluation criteria for the thermic condition are the exhaust gas temperature and the combustion air temperature measured at the temperature/measuring points T as shown in FIG. 1. Limit values that initiate a change-over of the appertaining regenerator/burner module can be defined for these temperatures. In addition to the limit value of the temperature, a time corridor or range can also be prescribed and applied.

Temperature measuring points Ts in a plurality of sectors, for example four sectors of the molten bath or at corresponding molten bath coordinates are additionally needed for a selected burner employment corresponding to the local furnace temperatures over the melt.

In addition to the measuring points for the temperature of the air and gas streams, measuring points can also be present for measuring the respective volume streams and/or measuring the respective gas analyses. Thus, the $O_2$ and $No_x$ content in the overall exhaust gas conduit 18 as well as the $O_2$ content in the combustion air 7 downstream from the exhaust gas return can be measured. The $O_2$ value measured in the combustion air thereat can be used for regulating the recirculating quantity of exhaust gas [exhaust gas return valve 18*r*].

A further operating modification becomes possible when an additional valve 18*a* is inserted into the exhaust gas conduit 18 downstream from the entry of the bypass 18*f*. During operating pauses, this valve enables a circulating mode of the hot smelting furnace gases with the exhaust gas ventilator 8*r* and a heating of the regenerators 3*r* cooled in burner mode.

It is self-evident that the inventive regenerator/burner module system or, respectively, the corresponding operating method can be automated. A temperature-guided change-over strategy of the modules should be strived for together with an optimally small range of control for the individual modules or, respectively, burners.

Figure 2:
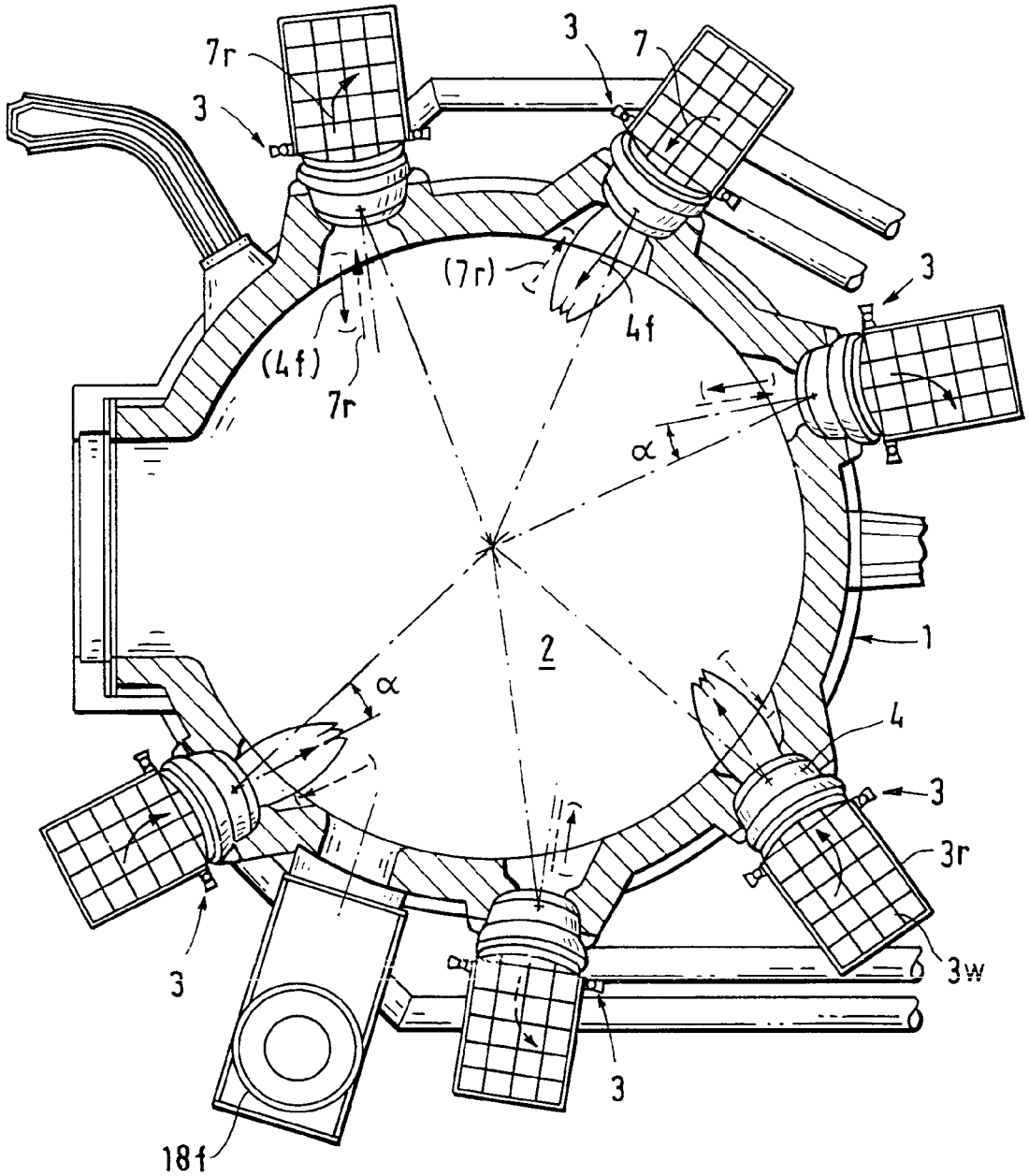
FIG. 2 Illustrates a horizontal section through a typical round smelting furnace with the structural arrangement of the regenerator/burner modules, shown at the level of the burner jets with removed deflection housing in front of the honeycomb members of the regenerators.

FIG. 2 shows the structural arrangement of six regenerator/burner modules 3 arranged at the circumference of a typical smelting furnace 1. The axes of the burner flames 4*f* can deviate in circumferential direction by an angle a from the radial direction to the middle of the round smelting furnace.

Whereas the ventilator system in FIG. 1 is composed of a ventilator 8 that only intakes combustion air 7 and a second ventilator 8*r* that only extracts exhaust gases 7*r*, FIGS. 3*a* and 3*b,* as alternative thereto, show reversible ventilators 8 with integrated reversing flaps that can both intake combustion air 7 as well as extract exhaust gas 7*r*. In this case, however, each individual module must be equipped with such a reversible ventilator. Given the regenerator/burner module shown in FIG. 3*a,* the reversing flap 9 is set in the ventilator admission housing 8E that the combustion air 7 is suctioned in from the ventilator intake connector 8*e*. As shown with section IV—IV in FIG. 4, the reversing flap 9 at the end of the spiral housing is set in the ventilator discharge housing 8A such that the outlet to the exhaust gas conduit is closed, and the combustion air 7 can flow to the regenerator/burner module 3. When, as shown with broken lines in FIG. 4, the reversing flaps at the ventilator discharge and admission are set in the reversing position 9*r*, as applies to the regenerator/burner module in FIG. 3*b,* then the connection to the regenerator is closed in the discharge housing 8A, and the ventilator extracts the furnace exhaust gases 7*r* via the regenerator 3*r* via the reversed reversing flap 9*r* in the admission housing. The connection to the admission connector 8*e* is thereby closed.

Figure 5:
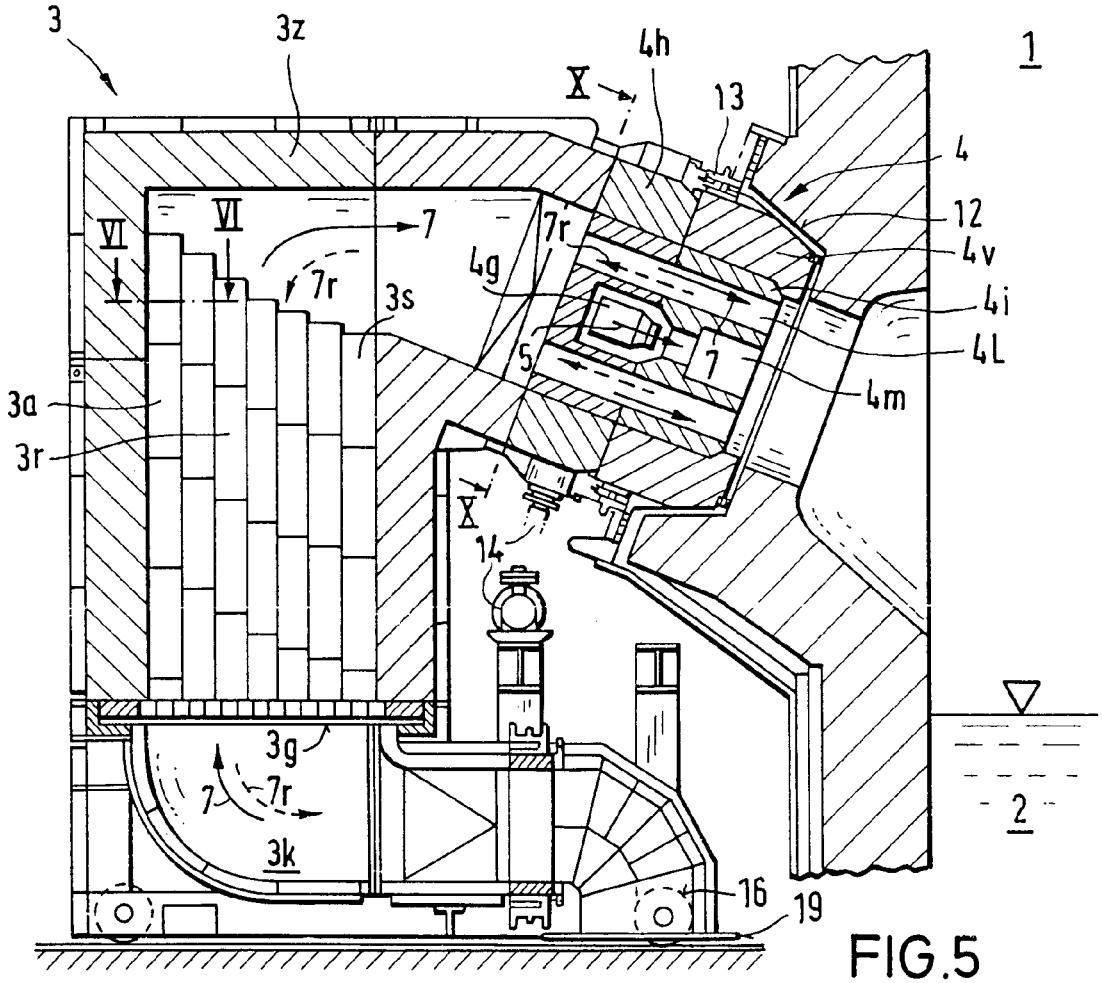
FIG. 5 Illustrates a vertical section through a regenerator/burner module with vertical honeycomb member regenerator and gas burner with flow management in burner and regenerator mode.

The vertical section of FIG. 5 shows details of an inventive regenerator/burner module 3 with the admission elbow 3*k,* the regenerator 3*r* and the burner 4 that has its front burner head 4*v* fitted into the wall of the smelting furnace 1 via a conical burner head seat 12. The entire regenerator/burner module can be moved out of the conical burner head seat as a complete unit after the connection of the connecting flange 19 has been undone. A truck, which can also be guided on rails, facilitates this removal away from the smelting furnace. The regenerator/burner module can also be moved away from the smelting furnace suspended from a craneway (not shown here).

Figure 6:
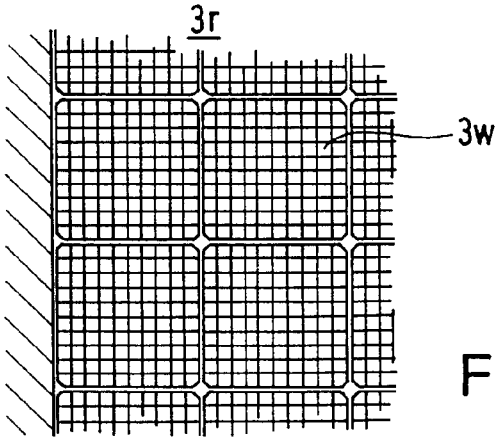
FIG. 6 Illustrates a partial cross-section VI—VI in FIG. 5 through joined honeycomb member elements with tight honeycomb grid.

The regenerator 3*r* is vertically arranged under an adapter 3*z* and is composed of ceramic honeycomb members 3*w* that are layered on a grating 3*g*. The partial section VI—VI is shown in FIG. 6 and shows a cross-section through the assembled honeycomb members 3*w*. It proves beneficial for a more uniform distribution of the flow to increase the flow resistance of the honeycomb member flow channels from the channels 3*s* at the side of the smelting furnace to those 3*a* at the outside. Given identical honeycomb members 3*w*, this is achieved in that more honeycomb members are increasingly layered on top of one another toward the outside—i.e. in the direction of the outside wall of the admission elbow 3*k* and of the intermediate elbow 3*z*—, and, thus, the outer honeycomb member layer 3*a* exhibits the longest flow channels with the highest flow resistance. A similar effect could also be achieved given approximately the same layer length of the honeycomb members if the flow cross-sections of the honeycomb members were diminished toward the outside wall. Because of the unequal honeycomb member, however, this leads to a greater outlay.

Compared to regenerator embodiments with ball fills or other gas-permeable fills, which can also be accommodated in the illustrated regenerator housing, the pressure losses of the honeycomb members given the same flow rate are approximately 1/100 of the pressure loss of a ball fill and are thus clearly lower. Moreover, soot and contaminants from the exhaust gases deposit only slightly at the channel walls in the larger flow cross-sections of the honeycomb members, so that the honeycomb member channels resist plugging up. Further, equipping the regenerators with honeycomb members also enables an oblique or horizontal arrangement of the regenerators. Given an equipping of the regenerator with a gas-permeable bulk fill, such an arrangement could only be implemented with substantially greater outlay. Alternatively to the vertical regenerator under the burner, as shown in the illustrations of FIGS. 5 and 7, vertical regenerators with honeycomb members can also be arranged above the burner in an analogously similar compact execution.

When the regenerator admission elbow 3*k* according to FIG. 7 is equipped with a deflection grating 15, then the individual grate paddles can also be executed swivellable. A part of the elbow cross-section can be blocked with transversely placed grate paddles, so that an air jet 15*s* flows through a partial cross-section of the regenerator 3*r* at increased speed up to the jet limit 15*g* in the remaining free flow cross-section. The increased flow rate in the honeycomb members strips dirt and soot particles that adhere to the honeycomb member walls, and the blow jet conveys the particles to the burner 4 for after-burning. FIG. 8 shows grate paddles in blow-off position for blowing off the honeycomb member at the smelting furnace side, and FIG. 9 shows the grate paddles in blow-off position for the honeycomb member at the outside. In this embodiment, only the paddle stem is respectively swivelled into turn-off position 15*a*. A blocking of the grate channel can be achieved with greater paddle divisions and, thus, with fewer paddles given 90° deflection paddles when only the paddle stem is swivelled.

The regenerator embodiment in FIG. 7 additionally has the introduction of a recirculation exhaust gas conduit 17 in the adapter 3*z* between burner and regenerator with a shutting flap 17*a* at the outlet. This shutting flap can be opened (broken-line position 17*r*), so that exhaust gas 7*r* from the furnace 1 can be suctioned through the recirculation exhaust gas conduit 17 into the regenerator 3*r* given regenerator mode. This allows a greater exhaust gas stream 7*r* to be passed through the regenerator 3*r* and thus allows the heat-up time to be correspondingly shortened. The shutting flap in FIG. 7 is a special embodiment with a double plate that, in opened position 17*r*, forms a triple diffuser with the walls of the discharge channel, so that the diffuser discharge jet spreads over the regenerator admission and the honeycomb members 3*w* of the regenerator 3*r* have a largely uniform flow-through.

However, this recirculation exhaust gas conduit 17 can also be opened—preferably partly—in burner mode in order to achieve a $NO_x$ reduction with this external exhaust gas recirculation. The shutting flap is thereby advantageously not brought into the completely open position 17*r* but is set opened at a slant, so that exhaust gas 7*r* from the recirculation exhaust gas conduit 17 and combustion air 7 flow approximately isodirectionally on the burner 4 in the intermediate housing 3*z*. Given this type of recirculation during burner mode, additional integration of a ventilator in the recirculation exhaust gas conduit 17 can be required.

By contrast to the conical burner head seat 12 in the wall of the smelting furnace 1, as FIG. 5 shows, the burner head seat 12 in FIG. 7 or, respectively, FIG. 7*a* has the form of an annulus-spherical cap. The mid-point K of the annulus lies on a vertical axis A—A that passes through the mid-point of the connecting flange 19, so that the entire regenerator/burner module 3 can be pivoted around the axis A—A in the annulus-spherical cap 12, after the flange fastening is released, without diminishing the seal at the burner head.

Figure 10:
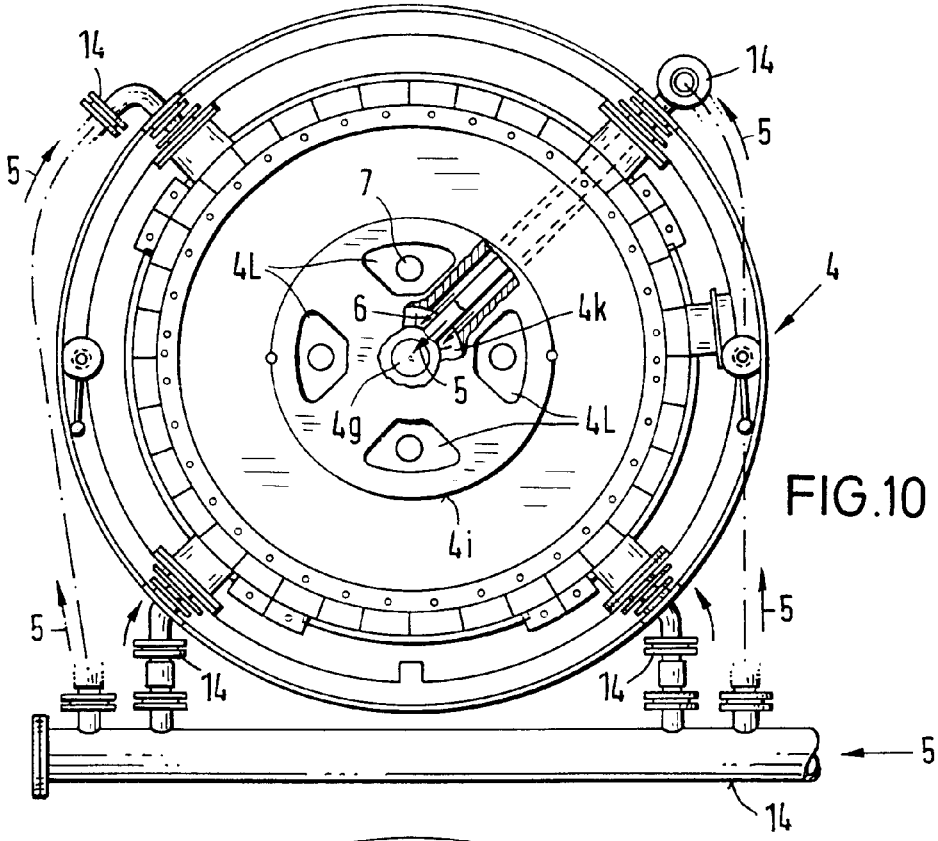
FIG. 10 Illustrates a section X—X in FIGS. 5 and 7 as viewed onto the burner head from behind given burner mode.
Figure 11:
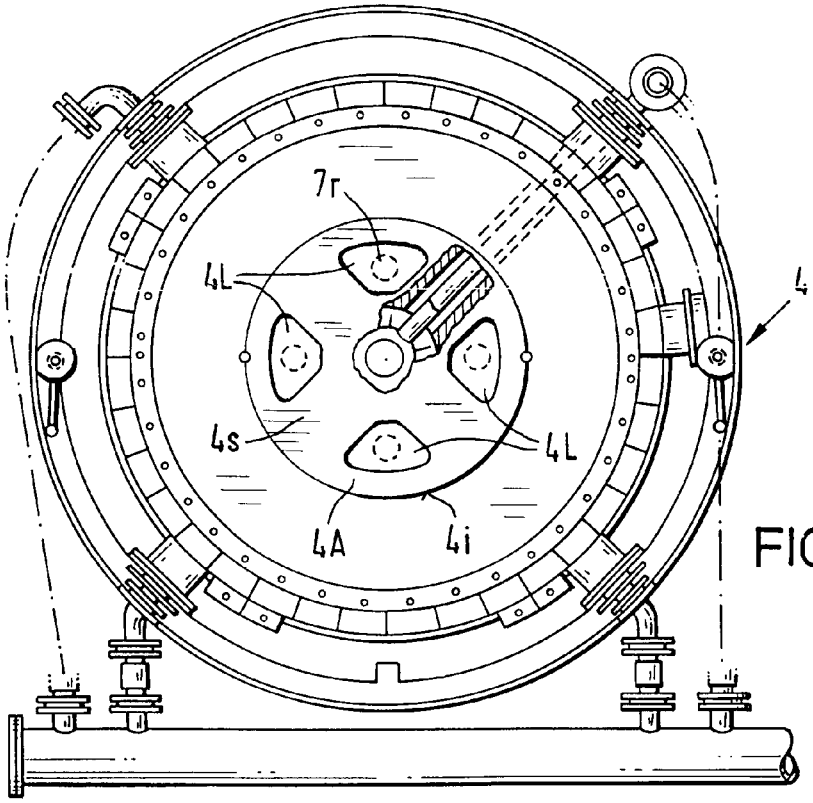
FIG. 11 Illustrates a section X—X in FIGS. 5 and 7 as viewed onto the burner head from behind given regenerator mode with exhaust gas return flow through the four air channels of the inner burner insert in the heating period of the regenerator.

FIG. 5 and FIG. 7 show an inventive regenerator/burner embodiment with a gas burner 4 whose cross-section (section X—X in FIG. 5) is shown in FIG. 10 in burner mode and in FIG. 11 in regenerator mode. The gas burner is bipartite and is composed of the front burner housing head 4*v* and the back burner housing 4*h*. The likewise bipartite, inner burner insert 4*i* of especially heat-resistant, usually ceramic material together with the gas jet 4*g* of heat resisting metal is fitted into this bipartite burner housing (see FIG. 5). At its outside circumference, the gas jet 4*g* has spacer webs, so that a cooling annular chamber 4*k* between the burner seat in the inside burner insert 4*i* and the gas jet 4*g* enables the throughput of coolant 6, for example cooling air or exhaust gas cooled to about 120° as largely inert gas (see FIG. 10 with section X—X from FIG. 5). To this end, approximately 10% of the cooled-down exhaust gas stream given regenerator mode can be taken, for example, respectively downstream of a regenerator and be cooled further with water or air in a heat exchanger. This exhaust gas sub-stream cooled to about 120° C. in this way is then supplied via annular chambers 4*k* as coolant 6 to the regenerator/burner that is in burner mode. The coolant 6 is laterally supplied into the cooling annular chamber through a plurality of radial pipelines (four pipelines in the exemplary embodiment) in the webs 4*s* of the inner burner insert 4*i*. The leads to the gas jet 4*g* of the burner for the fuel gas 5 are also located—with a smaller diameter in these radial pipelines. The inner burner insert 4*i* contains four channels for the combustion air 7. For enlarging the flow cross-sections, an outer wall 4A of the channels 4L to the burner housings 4*v* and 4*h* can be foregone, so that the inner burner insert 4*i* in such an embodiment is composed of four webs 4*s* for the leads for the fuel gas 5 and the coolant 6 with a seat in the inner bore of the burner housing 4*v* and 4*h*.

The lateral introduction of fuel and cooling gas and the largely divided execution of the component parts of the burner housing enables a comparatively simple replacement of worn parts and does not disturb the flow management in the inflow to the burner, as occurs in known embodiments with axial introduction of fuel gas and cooling gas. As FIG. 10 shows, the fuel gas 5 is introduced into the four radial fuel gas pipes in the gas burner 4*g* via gas distribution and admission pipes 14.

FIG. 11 shows the turned -off gas burner in regenerator mode. With the fuel gas turned off and after switching the ventilator system over, hot exhaust gas 7*r* from the smelting furnace 1 is suctioned in reverse flow direction through the combustion air channels 4L of the burner insert 4*i* for heating the regenerator 3*r*, as the broken-line flow arrows in FIG. 5 and FIG. 7 also show.

The inventive compact regenerator/burner module can be implemented with modifications. Instead of the admission elbow 3*k* to the regenerator 3, an inflow is directly possible in the direction of the regenerator axis via a short diffuser. Correspondingly, the intermediate housing 3*z* between regenerator 3*r* and burner 4 need not be an elbow. Given a corresponding arrangement of the regenerator/burner module, a straight adapter can also be provided.

The exemplary embodiments are in fact shown for a round smelting furnace with compact regenerator/burner modules that are operated with fuel gas. However, the inventive compact regenerator/burner modules, potentially with reversible ventilator system, can also be used for other types of industrial furnaces. For example, the arrangement of the regenerator/burner modules for burner mode at one furnace side and for regenerator mode at the other side with side-by-side change in operating mode can likewise be useful for some applications. Further, instead of being equipped with gas burners, the compact regenerator/burner modules can also be correspondingly equipped with burners suitable for liquid fuels.

The separate ventilators schematically shown, for example, in FIG. 1, namely the combustion air ventilator 8 and the exhaust gas ventilator 8*r*, can also be combined in one unit as a two-stream ventilator that works with a common rotor shaft, with combustion air flow 7 in the one direction and exhaust gas flow 7*r* in the other direction.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. An apparatus for heating a fuel-fired industrial furnace having a wall defining an interior for confining a molten bath, said apparatus comprising:

at least three regenerator-burner modules arranged at an outside of said wall to be in direct communication with said interior of said industrial furnace, each of said regenerator-burner modules including a regenerator and a burner which are detachably connected to said wall of said industrial furnace, a hot exhaust gas conduit flow connected to said interior of said industrial furnace though said regenerator-burner modules, a cold combustion air intake flow connected to said interior of said industrial furnace through said regenerator-burner modules, at least two ventilators, a first ventilator communicating with said cold combustion air intake, positioned between said air intake and said burner-regenerator modules, and adapted to selectively provide cold combustion air to said regenerator-burner modules as desired, and a second ventilator communicating with said hot exhaust gas conduit, positioned between said hot exhaust gas conduit and said burner-regenerator modules, and adapted to selectively provide hot exhaust gas to said hot exhaust gas conduit from said industrial furnace, each of said regenerator-burner modules being operable to produce a flame in a burner mode and to exhaust hot gases in a regenerator mode as selected, each of said regenerators being disposed between one of said burners and both of said ventilators for providing communication there between, and each of said burners comprising a back burner housing, a front burner housing head which seats into said wall of said industrial furnace to provide said detachable connection between said burner and said wall of said industrial furnace, and an inner replaceable burner insert disposed within said front burner housing head, a plurality of axial through-channels in said inner burner for permitting passage there though of combustion air or hot exhaust gas, and a gas jet disposed centrally relative to said through-channels, and a controller operatively connected to the regenerator-burner modules and having output signals which control each regenerator-burner module independently to be in either the burner mode or the regenerator mode.

2. The apparatus of claim 1, wherein said regenerator of each of said regenerator-burner modules comprises a heat storing mass composed of a gas-permeable bulk fill for storing heat transferred thereto from hot exhaust gas passing over said regenerator when said regenerator-burner modules operate in said regenerator mode.

3. The apparatus of claim 2 wherein said gas-permeable bulk fill comprises a plurality of ball or ring shaped heat storing masses.

4. The apparatus of claim 2 wherein said gas-permeable bulk fill comprises a plurality of elongate ceramic tube sections placed adjacent and end to end relative to one another over the entire regenerator cross section wherein said tube sections placed end to end are axially offset relative to one another.

5. The apparatus of claim 4 wherein said ceramic tube sections further comprise elongate members having a honeycomb shape in cross section.

6. The apparatus of claim 4 wherein said ceramic tube sections are constructed and arranged to increase the flow resistance across each of said regenerators at a portion of said regenerators furthest from said industrial furnace.

7. The apparatus of claim 1 wherein each of said burners is directed obliquely down onto said molten bath within said furnace such that said burners blow hot air into said furnace towards said molten bath when operating in said burner mode.

8. The apparatus of claim 1 wherein each of said regenerators is oriented vertically.

9. The apparatus of claim 1, wherein each of said regenerator/burner modules further comprises an intermediate housing disposed between said burner and said regenerator.

10. The apparatus of claim 1 wherein said burner further comprises a lateral leas through which cooling air or cooled exhaust gas flows around said fuel gas jet.

11. The apparatus of claim 1 wherein each of said regenerator/burner modules is removable relative to said industrial furnace without affecting operation of said industrial furnace.

12. The apparatus of claim 11 wherein each of said regenerator-burner modules further comprises an integral truck received on guide rails for removing said regenerator-burner modules from said industrial furnace.

13. The apparatus of claim 1 further comprising a deflection paddle grating disposed between said ventilators and each of said regenerators wherein each deflection paddle grating is movable to partially block flow over a cross section of each of said regenerators.

14. The apparatus of claim 1 wherein said ventilators are replaced by a reversible ventilator adjacent each of said regenerator-burner modules, each of said ventilators having reversing flaps disposed therein so that when in a first position said reversing flaps direct cold combustion air from said cold combustion air intake into each of said regenerator-burner modules, and when in a second position said reversing flaps direct hot exhaust gas drawn from each of said regenerator-burner modules into said exhaust gas conduit.

15. The apparatus of claim 14 wherein said reversible ventilators associated with each of said regenerator-burner modules further comprises a single ventilator unit having a common rotor shaft which when rotating in one direction delivers cold combustion air to its respective regenerator-burner module and when rotating in an opposite direction draws hot exhaust gas from said furnace through each of said regenerator-burner modules.

16. The apparatus of claim 1, wherein the controller comprises a valve system associated with each regenerator-burner module and alternatively connecting the regenerator/burner module to one of the hot exhaust gas conduit and the cold combustion air intake.

* * * * *